United States Patent [19]

Mehlin et al.

[11] Patent Number: 5,042,672

[45] Date of Patent: Aug. 27, 1991

[54] STORAGE SYSTEM, ESPECIALLY FOR MAGAZINES AND THE LIKE

[75] Inventors: Per-Erland Mehlin, Lund; Leif Palsson, Bara, both of Sweden

[73] Assignee: BTJ Produkter AB, Lund, Sweden

[21] Appl. No.: 435,414

[22] PCT Filed: May 31, 1988

[86] PCT No.: PCT/SE88/00295

§ 371 Date: Oct. 24, 1989

§ 102(e) Date: Oct. 24, 1989

[87] PCT Pub. No.: WO88/09729

PCT Pub. Date: Dec. 15, 1988

[30] Foreign Application Priority Data

Jun. 2, 1987 [SE] Sweden ..... 8702286

[51] Int. Cl.[5] ..... A47B 65/00

[52] U.S. Cl. ..... 211/42; 211/41; 211/170

[58] Field of Search ..... 211/41, 81, 80, 170, 211/126, 96, 150, 42

[56] References Cited

U.S. PATENT DOCUMENTS

| | | | |
|---|---|---|---|
| 352,925 | 11/1886 | Mathews | 211/81 X |
| 729,619 | 6/1903 | Luensmann | 211/81 X |
| 777,438 | 12/1904 | Schlanzer . | |
| 892,830 | 7/1908 | Hobbs et al. . | |
| 1,009,977 | 11/1911 | Kirkaldie . | |
| 2,006,447 | 7/1935 | Davidson et al. | 211/81 |
| 2,779,649 | 1/1957 | Neilson | 211/81 X |
| 3,193,339 | 7/1965 | Cooper | 211/81 X |
| 3,259,748 | 7/1966 | Lammers | 211/80 X |

FOREIGN PATENT DOCUMENTS

| | | |
|---|---|---|
| 1146631 | 4/1963 | Fed. Rep. of Germany . |
| 345248 | 5/1972 | Sweden . |
| 2063651 | 12/1979 | United Kingdom . |

*Primary Examiner*—Carl D. Friedman
*Assistant Examiner*—Derek J. Berger
*Attorney, Agent, or Firm*—Marshall & Melhorn

[57] ABSTRACT

A storage system, especially for magazines and the like, comprising at least one storage box having an upwardly open top, and a holder for the box. The holder (2, 3) comprises a hinge (4, 5) allowing pivotal movement of the box in one plane, and further a first stop member (8) defining a swung-out position of the box in which the open top thereof takes a substantially acute angular position relative to the horizontal plane, and a second stop member (9) defining a swung-in position of the box in which the open top thereof is substantially parallel to the horizontal plane. The hinge connection is releasable in the swung-in position of the box and only in this position, by translational movement of the box substantially perpendicular to the horizontal plane, said movement being positively controlled by the hinge and/or the holder.

8 Claims, 2 Drawing Sheets

STORAGE SYSTEM, ESPECIALLY FOR MAGAZINES AND THE LIKE

The invention relates to a storage system for magazines, leaflets and the like, comprising a plurality of storage boxes and a holder therefor.

At present, storage systems for magazines consist of magazine boxes and a bookcase on the shelves of which the boxes are placed. The boxes are upwardly open. When one wishes to find a magazine in a box and take it out, the box is first removed from the shelf and put on a table or the like. The alternative of tilting the box out of the shelf to make the opening accessible, or taking the box down from the shelf and holding it against one's chest, is impractical because this leaves only one hand free to remove the magazine. Also if one proceeds as first above mentioned, one hand must sometimes be used for holding the box, for example when the magazine has been found and is to be removed from the box.

The object of the invention is to provide a storage system where these drawbacks are eliminated, i.e. a system which allows storage of the magazines in superposed boxes arranged on planar surfaces and open at the top, but which allows searching for and removing of a magazine while using both hands. The system shall further allow the boxes to be moved in a practical and simple manner.

These objects are achieved by means of a system according to the claims.

Figure 1:
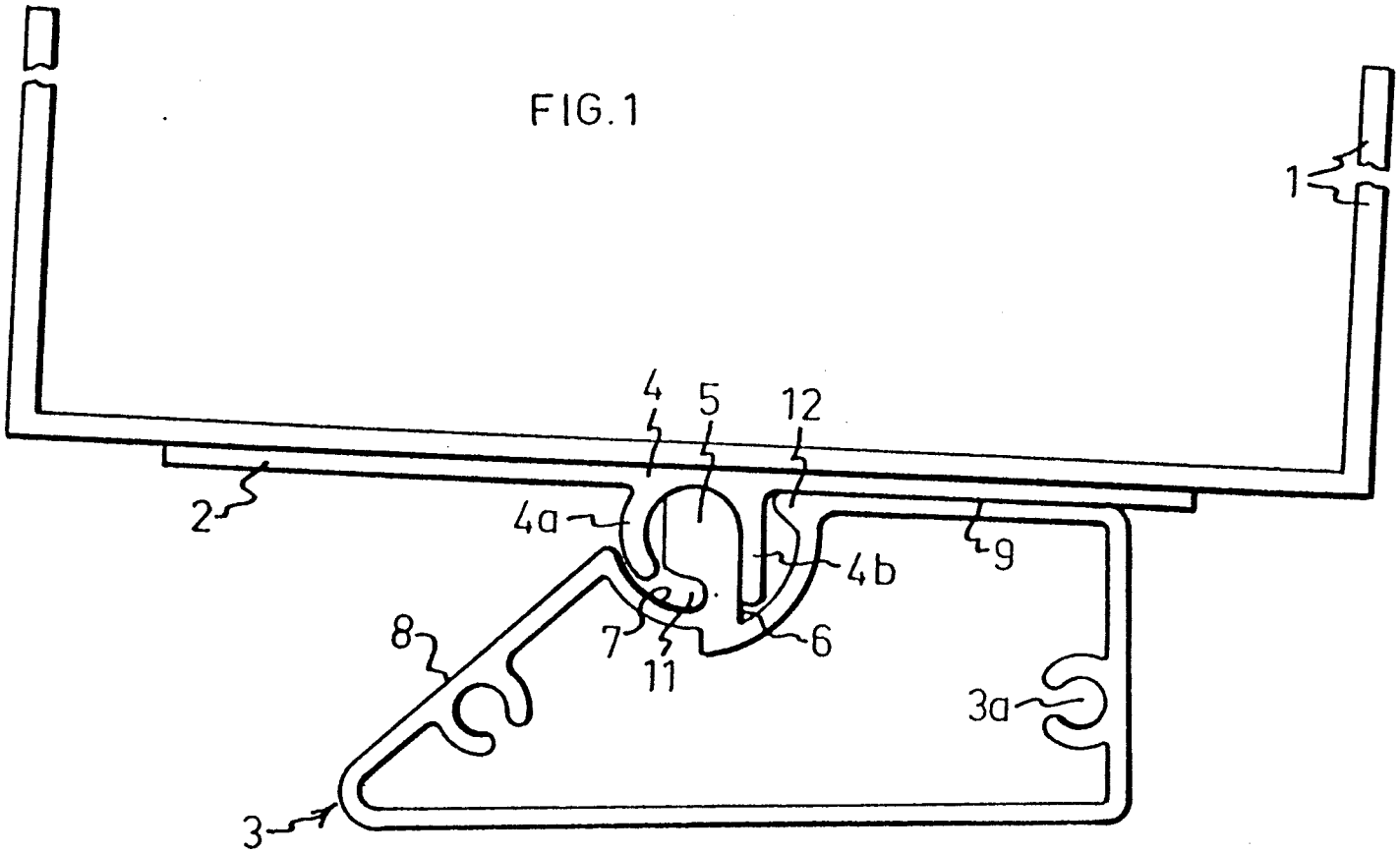
Figure 2:
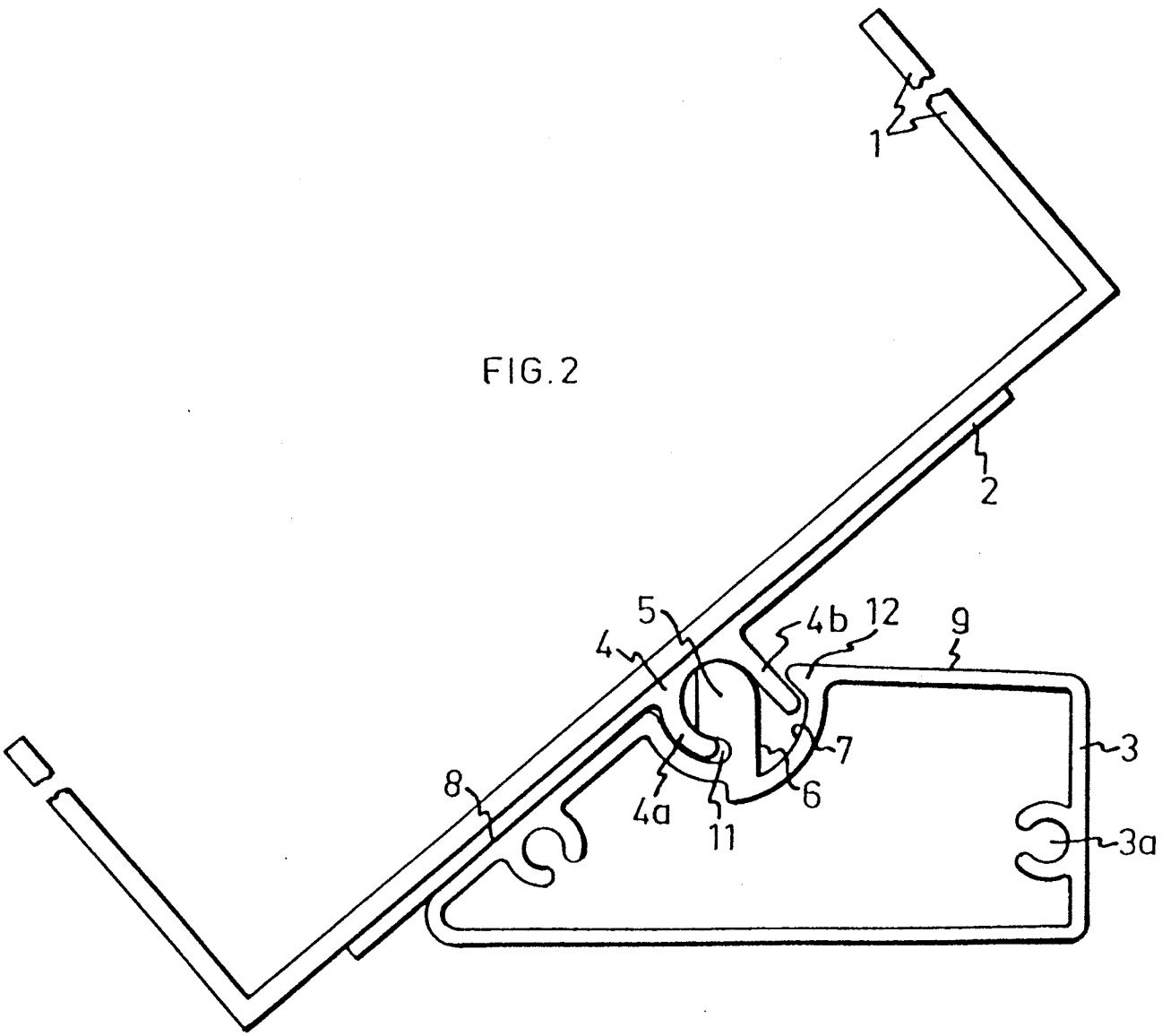

The invention will now be described in greater detail with reference to FIGS. 1 and 2 of the accompanying drawings which illustrate an embodiment.

In these Figures, the system according to the invention is shown in cross-section, the box being partly broken away. The box 1 which can be of conventional type for storage of magazines, is mounted in a suitable manner on an attachment plate 2 which is wider than the box. A plurality of identical boxes are pivotably mounted on a support section 3 which is mounted horizontally between two end walls by means of attachment holes 3*a*. Pivotability is achieved by means of a hinge formed of a sleeve 4 which is arranged at the lower side of the attachment plate and whose bottom portion is slit, and a rib 5. The rib or hinge pin 5 has, at its bottom, a connection 6 with a cradle 7 which at the front side of the system merges with a first stop surface 8 making an angle of about 35–40°, preferably about 40°, with the horizontal plane, and which at the rear side of the system merges with a second stop surface 9 making an angle of about 93° with the vertical plane. The stop surfaces 8, 9 define the end positions of the pivot movement of the box: the first stop surface defines a swung-out position (FIG. 2) in which the box contents are easily get-at-able through the box top, and a swung-in storage position (FIG. 1).

The inside of the sleeve has the form of a circular arc extending through more than 180°. The outside of its front wall 4*a* is convexly arcuate and corresponds to the cradle inner surface which thus is concavely arcuate. The cradle 7 forms together with the pin 5 a channel 11 extending to the connection 6 and having a width adapted to receive the sleeve wall 4*a* with a close-running fit when the box is pivoted to its swung-out position. The close-running fit causes the box to pivot accurately and without play. The pin 5 has the form of a circular segment extending through more than 180°, and its straight segment surface is vertical and facing forwardly and so large that the free end of the sleeve front wall 4*a* goes clear thereof when the box has taken its swung-in position. Thus, the box can be released from the hinge joint in this position, but only in this position.

The inside of the sleeve rear wall 4*b* is extended tangentially by a straight portion which, in the swung-in position of the box, rests against the corresponding vertical rear portion of the connection 6. The interaction of the outside of the extended portion with an abutment 12 extending inwardly from the rear part of the cradle 7, renders it difficult to accidentally disconnect the box from the hinge joint in the swung-in position of the box.

In a variant, a stop member protrudes from the segment surface and extends in a horizontal plane, which allows pivotal movement of the box towards the inclined plane 8 and thus removal of the box, the sleeve wall 4*b* going clear of the abutment 12.

The invention is, of course, not restricted to the embodiments described above and shown in the drawings, but can be modified in various ways within the scope of the inventive idea.

We claim:

1. A storage system, for magazines and the like, comprising:

a storage box;

a holder including:

a first horizontally disposed supporting surface, and a second supporting surface angularly disposed in respect of the first surface, said holder formed as a support rail for mounting between a pair of spaced apart vertical end walls; and a hinge means pivotally interconnecting said storage box and said holder, wherein said storage box and said holder can be uncoupled from each other exclusively in a single position, whereby the first supporting surface of said holder supports said storage box in a first position and the second supporting surface of said holder supports said storage box in a second position, said hinge means including a hinge pin attached to one of said storage box and said holder, and a slit hinge sleeve attached to the other one of said storage box and said holder and pivotally interconnected with the hinge pin whereby the hinge sleeve and the hinge pin can be uncoupled from each other exclusively in the single position.

2. The storage system as claimed in claim 1, wherein said hinge means is disposed intermediate the first supporting surface and the second supporting surface of said holder.

3. The storage system as claimed in claim 1, wherein the hinge pin is formed as a rib on the support wall.

4. The storage system as claimed in claim 1, wherein the hinge pin includes a sleeve abutting surface and the slit hinge sleeve includes a hinge pin abutting surface, whereby the sleeve abutting surface and the hinge pin abutting surface abut one another when said storage box is in the first position.

5. The storage system as claimed in claim 1, wherein said holder includes:

a pair of attachment holes formed at opposing ends of said holder for mounting said holder between a pair of spaced apart vertical end walls.

6. A storage system, for magazines and the like, comprising:

a storage box;

a holder including:

a first horizontally disposed supporting surface, and a second supporting surface angularly disposed in respect of the first surface; and a hinge means pivotally interconnecting said storage box and said holder, wherein said storage box and said holder can be uncoupled from each other exclusively in a single position, whereby the first supporting surface of said holder supports said storage box in a first position and the second supporting surface of said holder supports said storage box in a second position, said hinge means including a cradle having a first edge attached to an edge of the first supporting surface including an abutment formed at the first edge, and a second edge attached to an edge of the second supporting surface, a hinge pin attached to the cradle, and a slit hinge sleeve attached to said storage box and pivotally interconnected with the hinge pin, whereby the hinge sleeve and the hinge pin can be uncoupled from each other exclusively in the single position, the abutment formed at the first edge of the cradle preventing said storage box from uncoupling from said holder when said storage box is in the second position.

7. The storage system as claimed in claim 6, wherein the cradle is arcuate between the first edge and the second edge.

8. The storage system as claimed in claim 6, wherein the abutment extends toward the hinge pin.

* * * * *